US006845534B1

(12) United States Patent
Huang

(10) Patent No.: US 6,845,534 B1
(45) Date of Patent: Jan. 25, 2005

(54) SUPPORT PILLOW

(76) Inventor: Chia-Sh Huang, No. 268-5, Ching-Liao, Mo-Lin Tsun, Hou-Pi Hsiang, Tainan Hsien (TW)

( * ) Notice: Subject to any disclaimer, the term of this patent is extended or adjusted under 35 U.S.C. 154(b) by 0 days.

(21) Appl. No.: 10/661,192

(22) Filed: Sep. 12, 2003

(51) Int. Cl.[7] ..... A47G 9/00

(52) U.S. Cl. ..... 5/639; 5/632; 5/636; 5/640; 5/637; 5/485; 5/944; 297/397; 297/393

(58) Field of Search ..... 5/636, 639, 640, 5/644, 637, 485, 632, 944; 297/393, 397

(56) References Cited

U.S. PATENT DOCUMENTS 4,031,578 A * 6/1977 Sweeney et al. ..... 5/426
5,544,378 A * 8/1996 Chow ..... 5/644
5,898,962 A * 5/1999 McNeal ..... 5/639
6,061,854 A * 5/2000 Crowley ..... 5/655
6,073,288 A * 6/2000 Berenstein ..... 5/636
6,123,389 A * 9/2000 O'Connor et al. ..... 297/397

* cited by examiner

*Primary Examiner*—Alexander Grosz
(74) *Attorney, Agent, or Firm*—Trop, Pruner & Hu, P.C.

(57) ABSTRACT

A support pillow includes a U-shaped body skin that defines a U-shaped inner space therein, and a filler that is packed in the inner space and that cooperates with the body skin to form a flexible U-shaped body including a bight part and two opposite arm parts extending and angled away from two opposite ends of the bight part to define a recess thereamong.

3 Claims, 14 Drawing Sheets

SUPPORT PILLOW

BACKGROUND OF THE INVENTION

1. Field of the Invention

This invention relates to a support pillow, more particularly to a U-shaped support pillow.

2. Description of the Related Art

Conventional support pillows are normally rectangular in shape and cannot provide appropriate and comfort support for all of the various lying postures of the user.

SUMMARY OF THE INVENTION

Therefore, the object of the present invention is to provide a support pillow that is capable of overcoming the aforesaid drawback of the prior art.

According to the present invention, there is provided a support pillow that comprises: a U-shaped body skin that defines a U-shaped inner space therein; and a filler that is packed in the inner space and that cooperates with the body skin to form a flexible U-shaped body which includes a bight part and two opposite arm parts extending and angled away from two opposite ends of the bight part to define a recess thereamong.

BRIEF DESCRIPTION OF THE DRAWINGS

In drawings which illustrate embodiments of the invention.

DETAILED DESCRIPTION OF THE PREFERRED EMBODIMENTS

Figure 1:
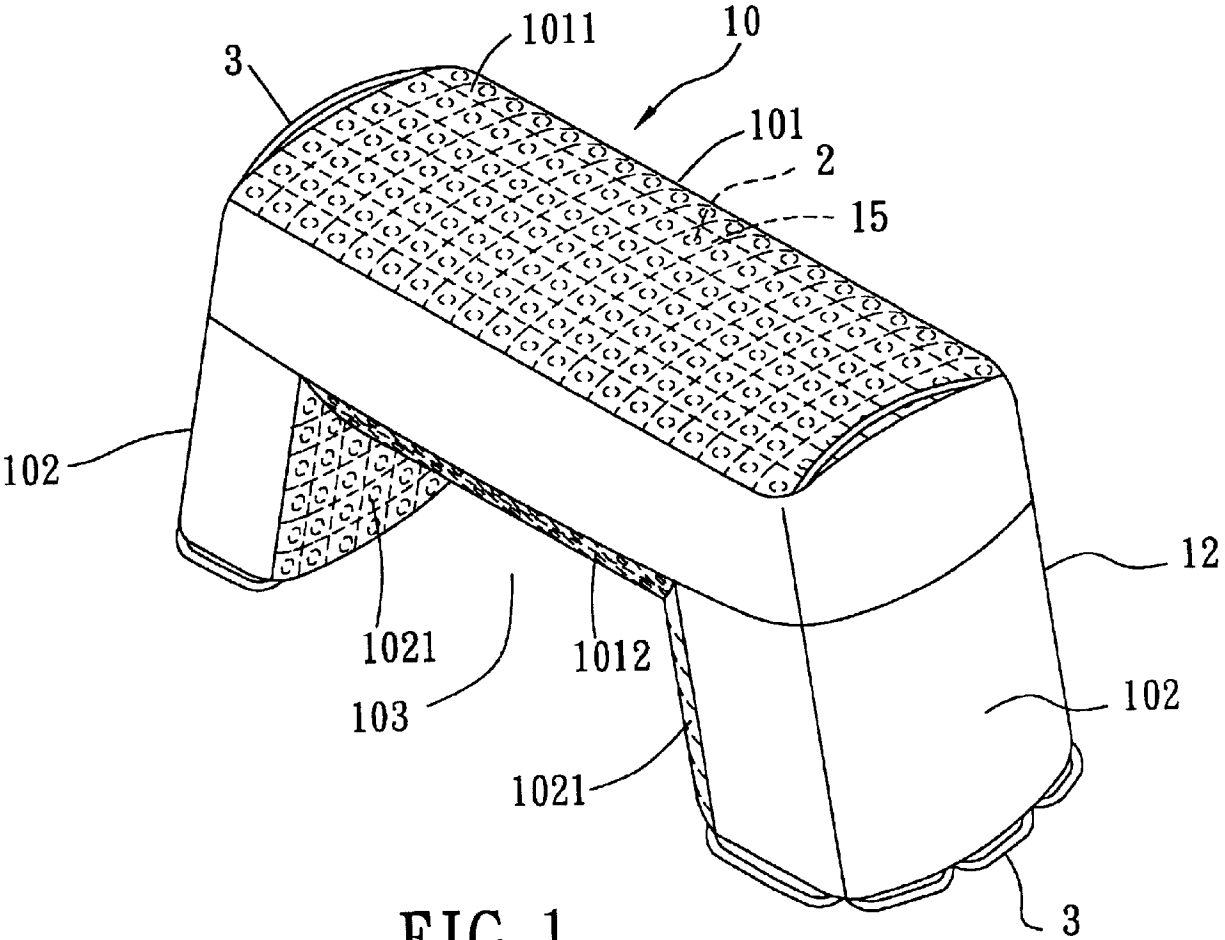
FIG. 1 is a perspective view of the first preferred embodiment of a support pillow according to this invention.

For the sake of brevity, like elements are denoted by the same reference numerals throughout the disclosure.

Figure 2:
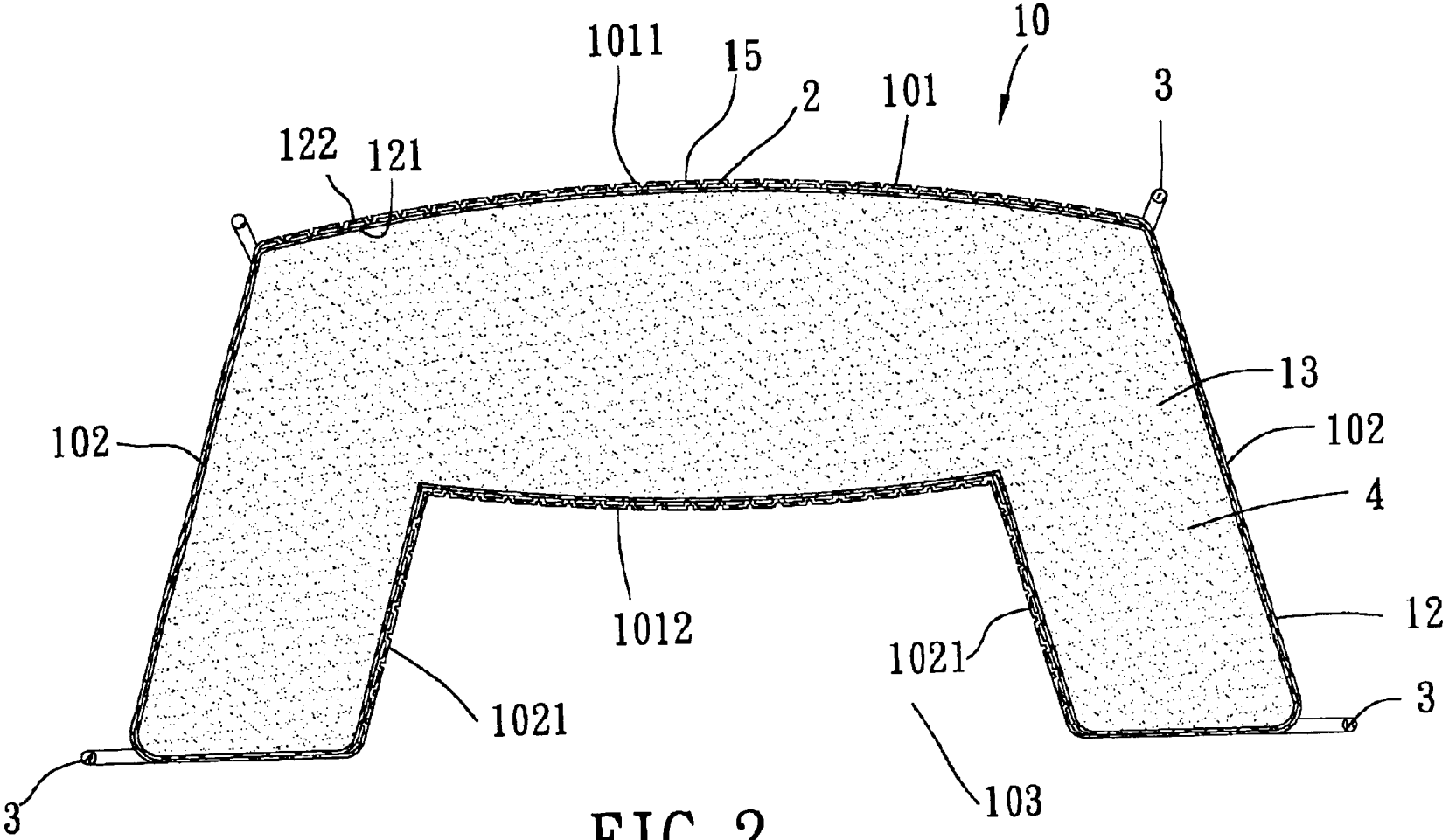
FIG. 2 is a sectional side view of the support pillow of FIG. 1.
Figure 3:
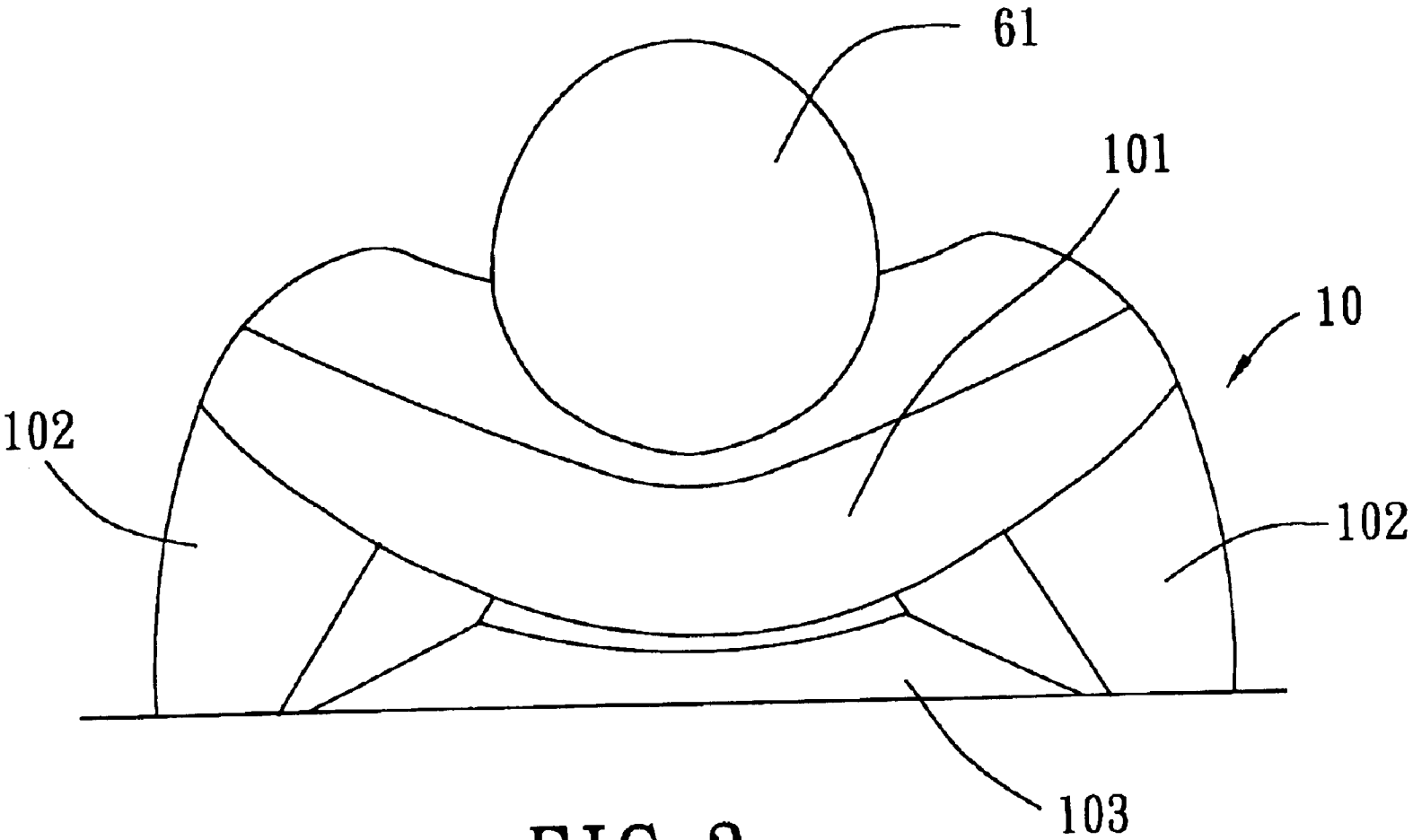
FIGS. 3 to 13 are schematic views to illustrate how the support pillow of FIG. 1 can be used for supporting various lying postures of the user.
Figure 4:
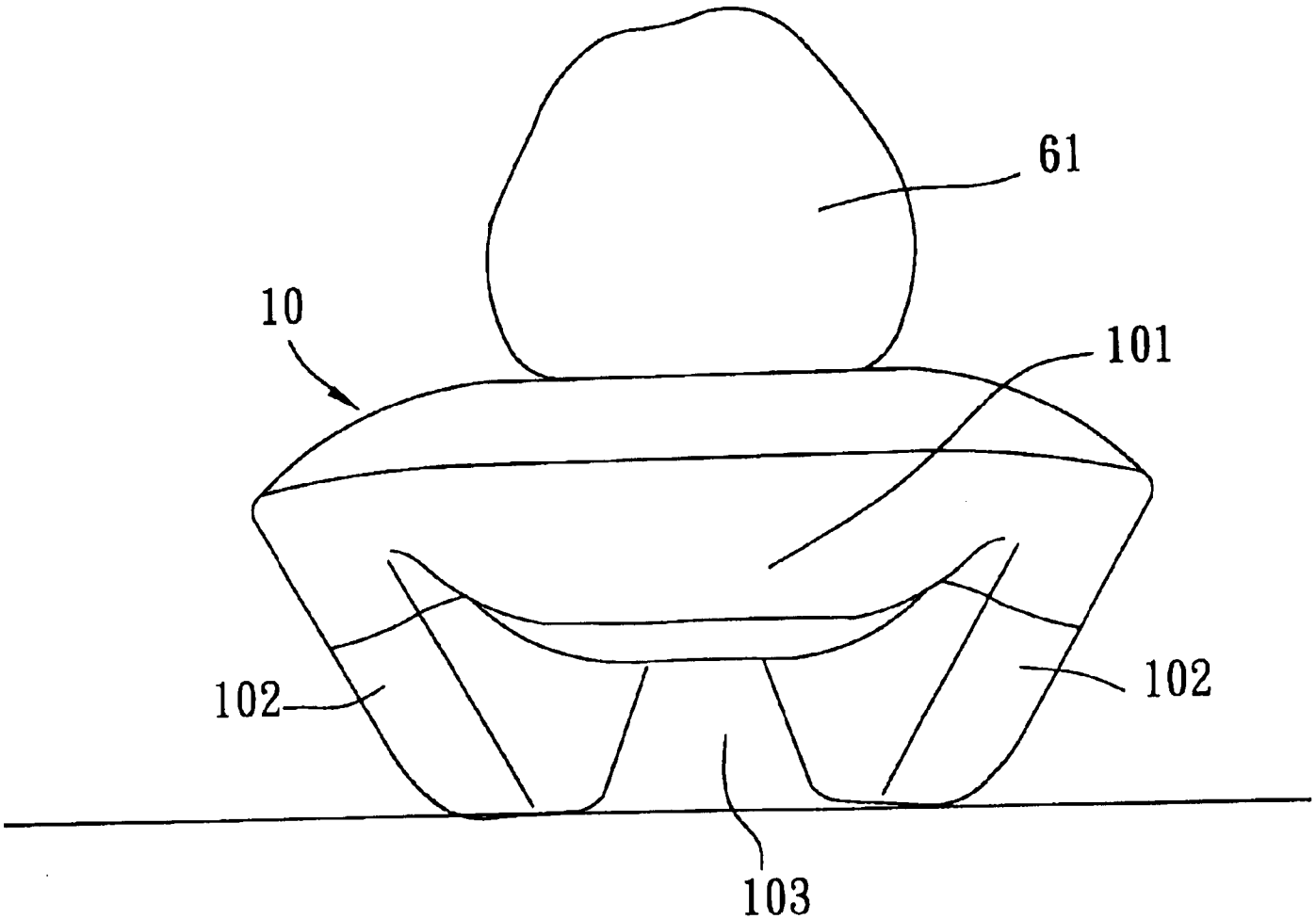
Figure 5:
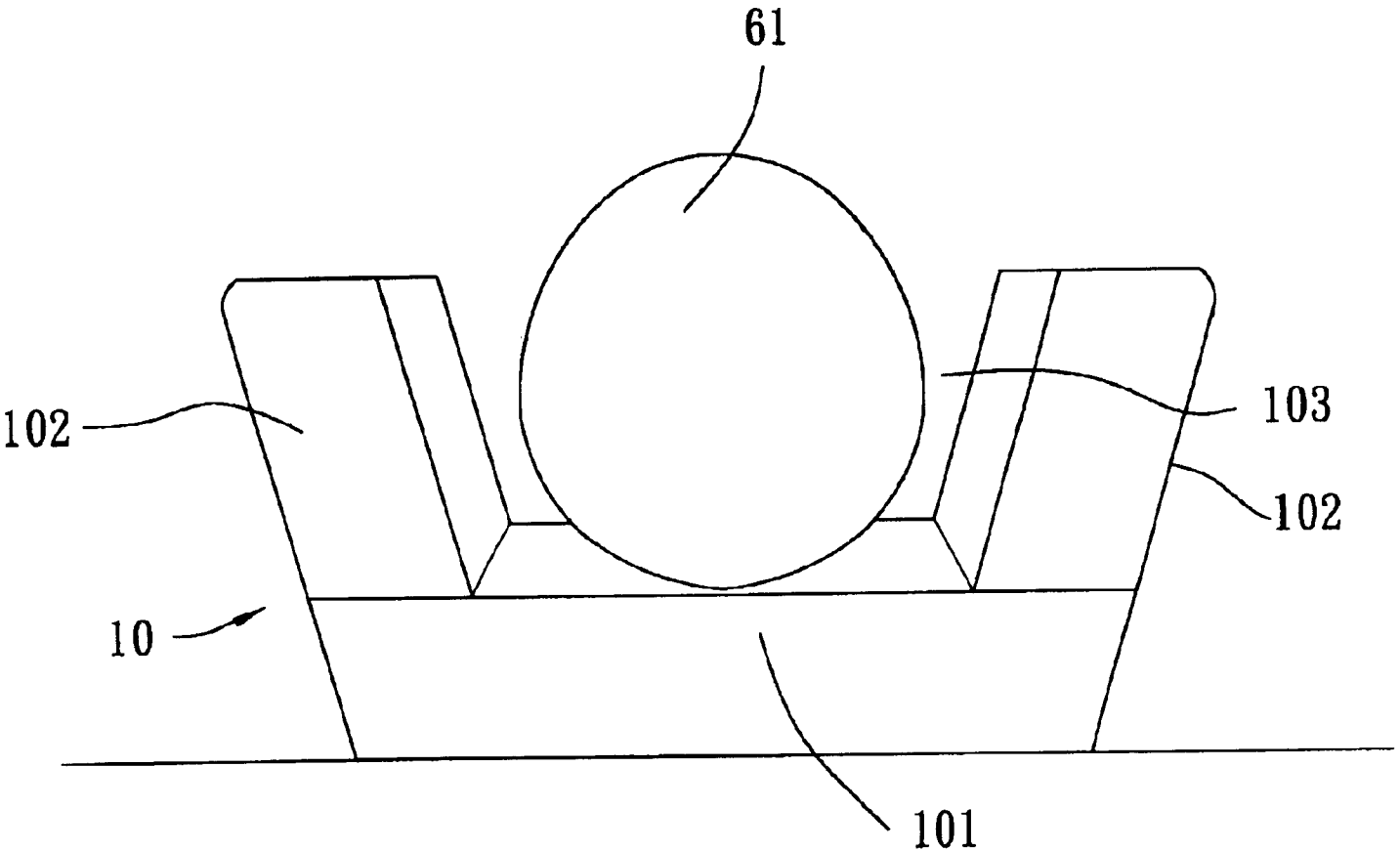
Figure 6:
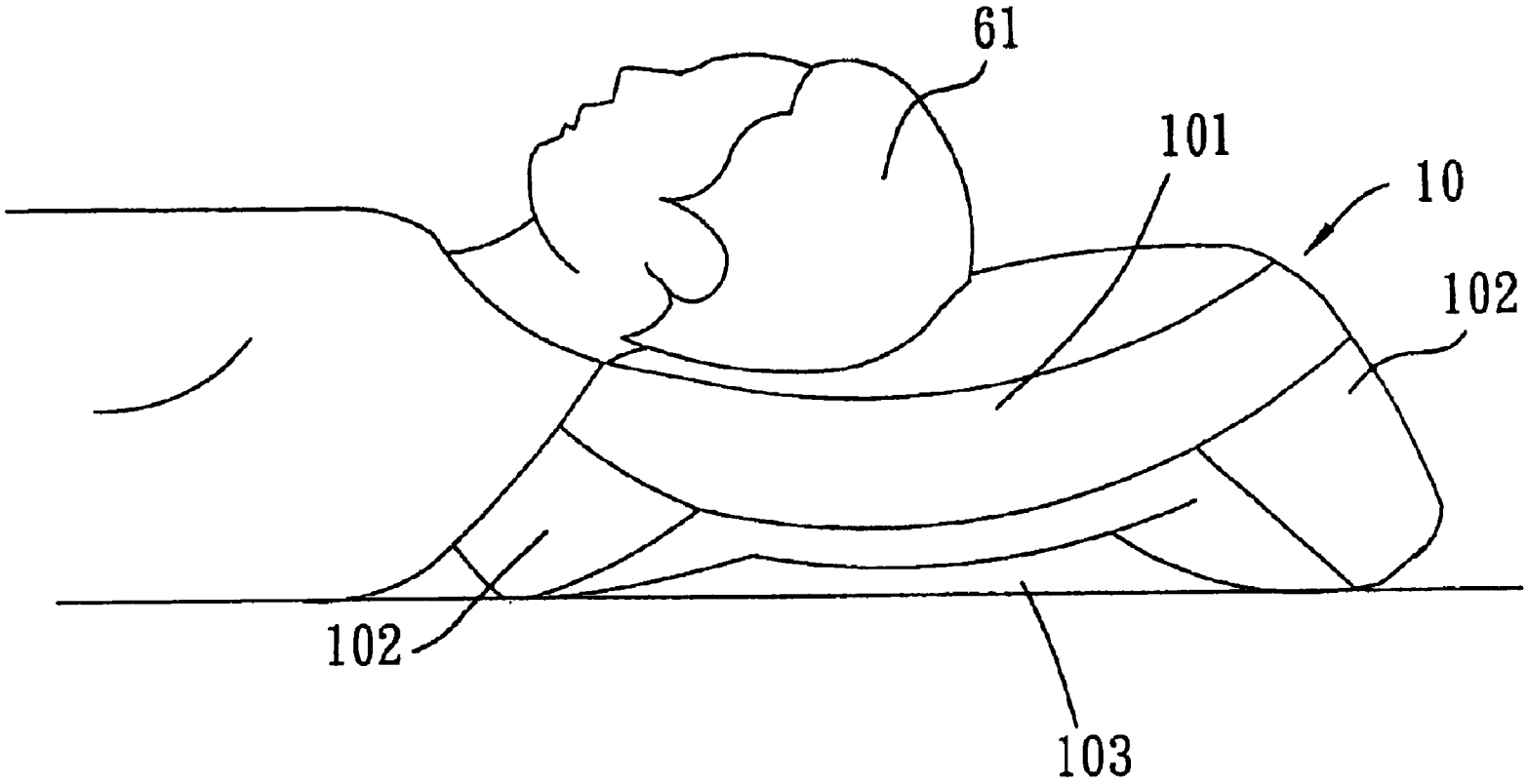
Figure 7:
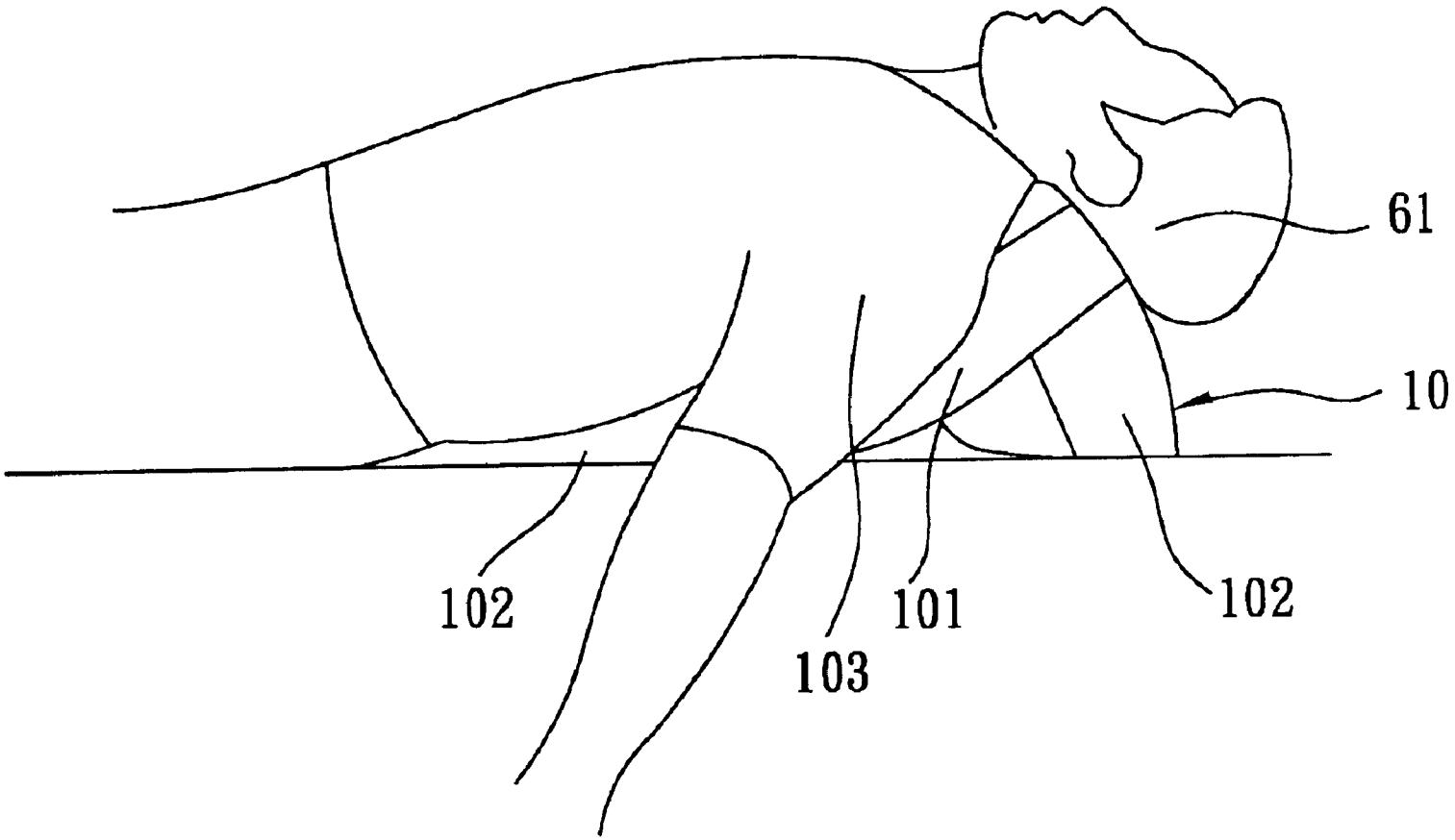
Figure 8:
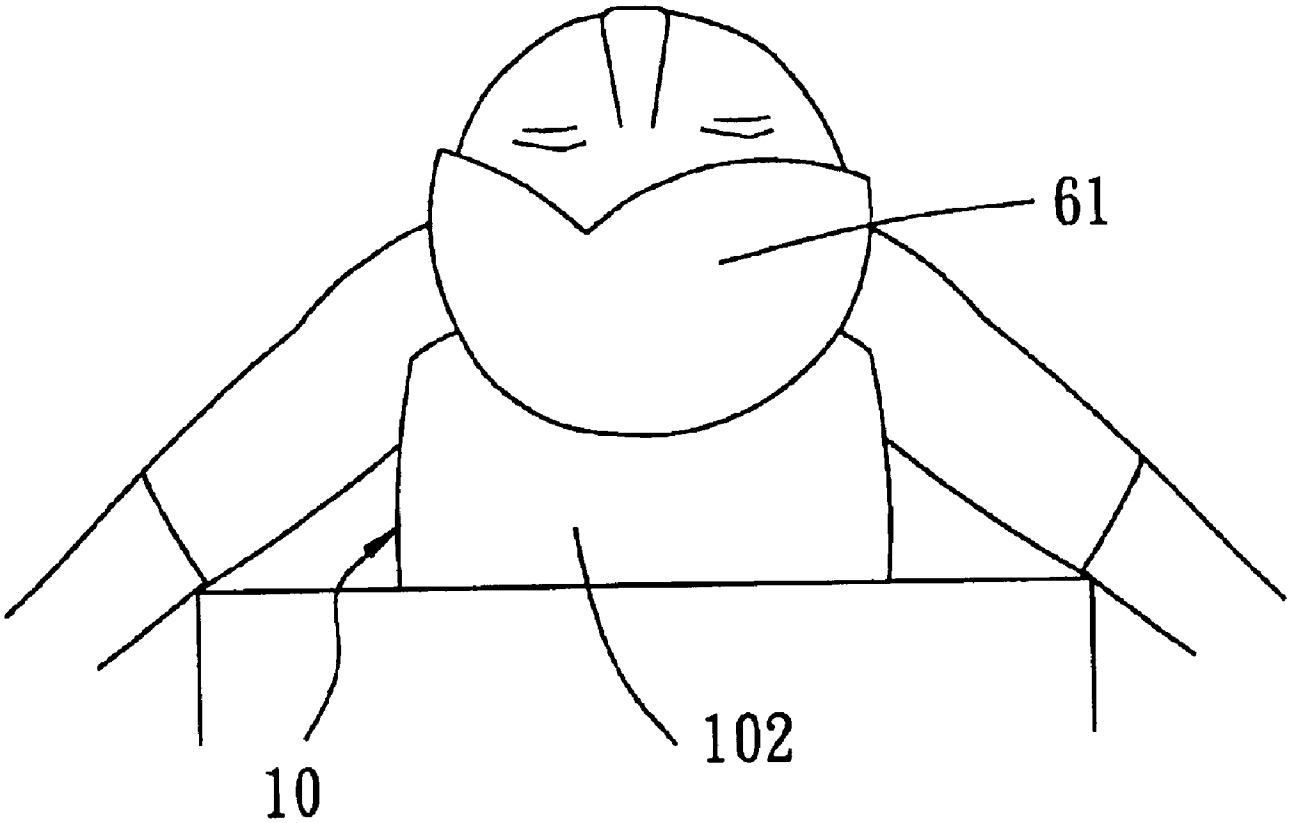
Figure 9:
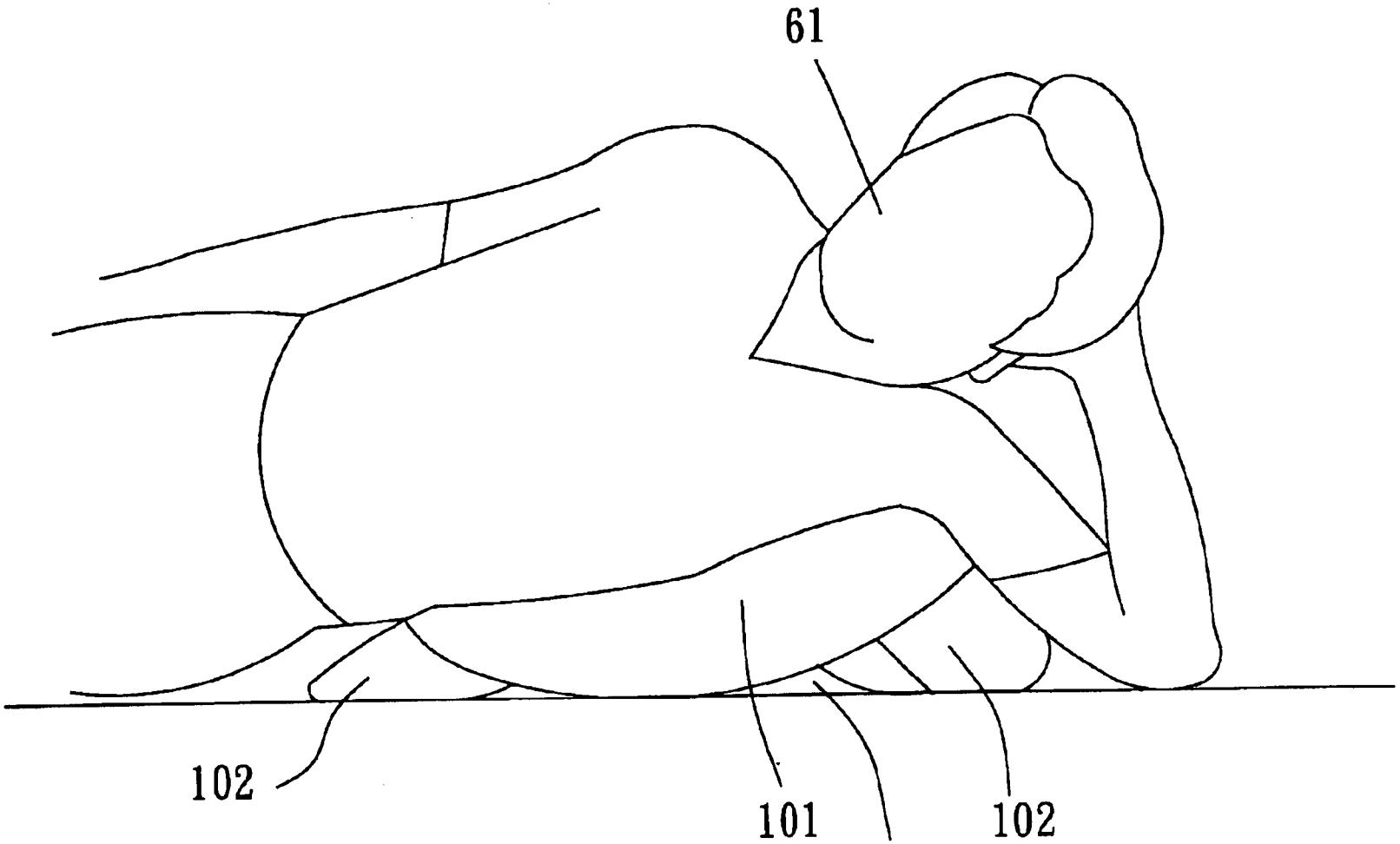
Figure 10:
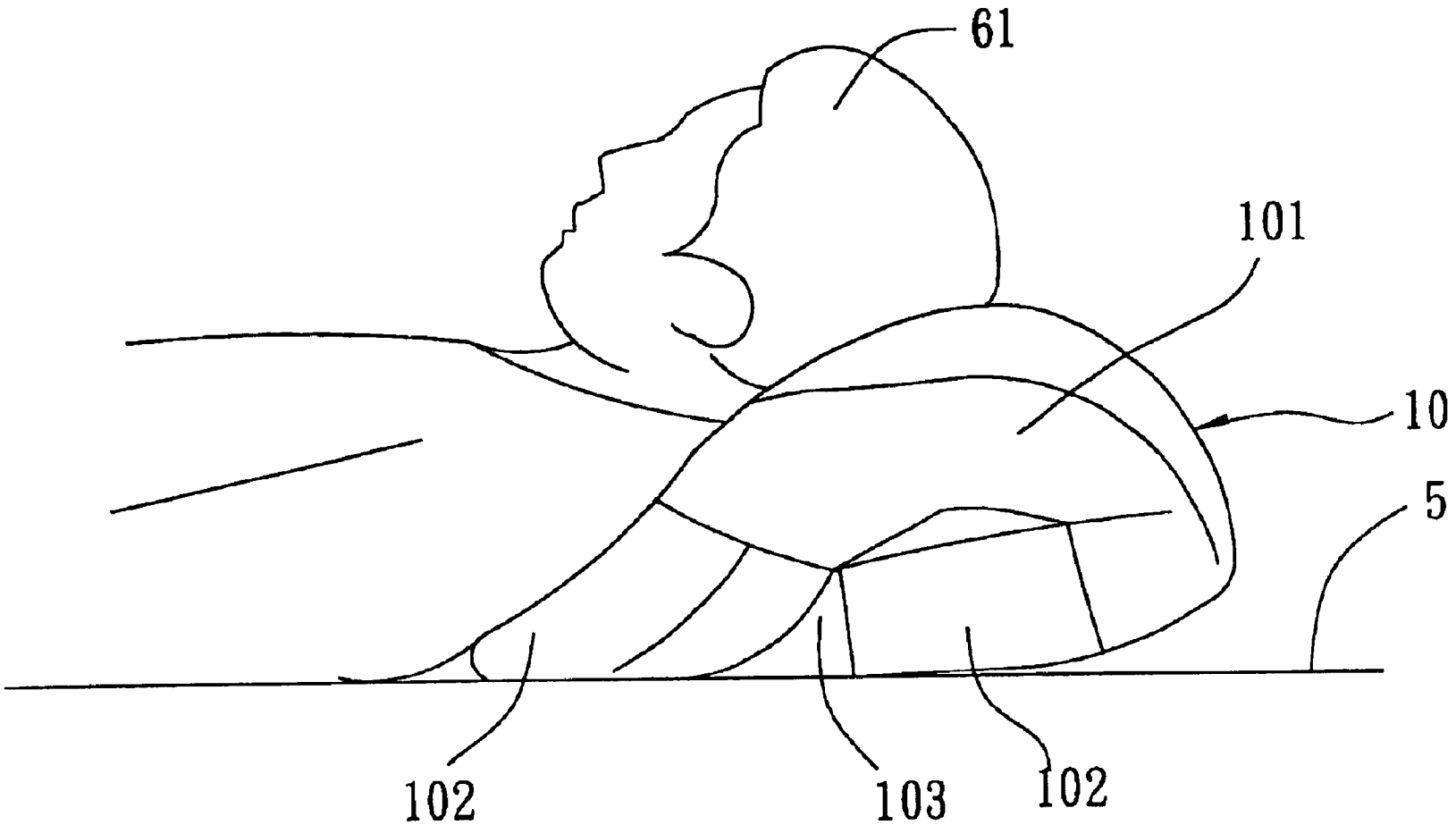
Figure 11:
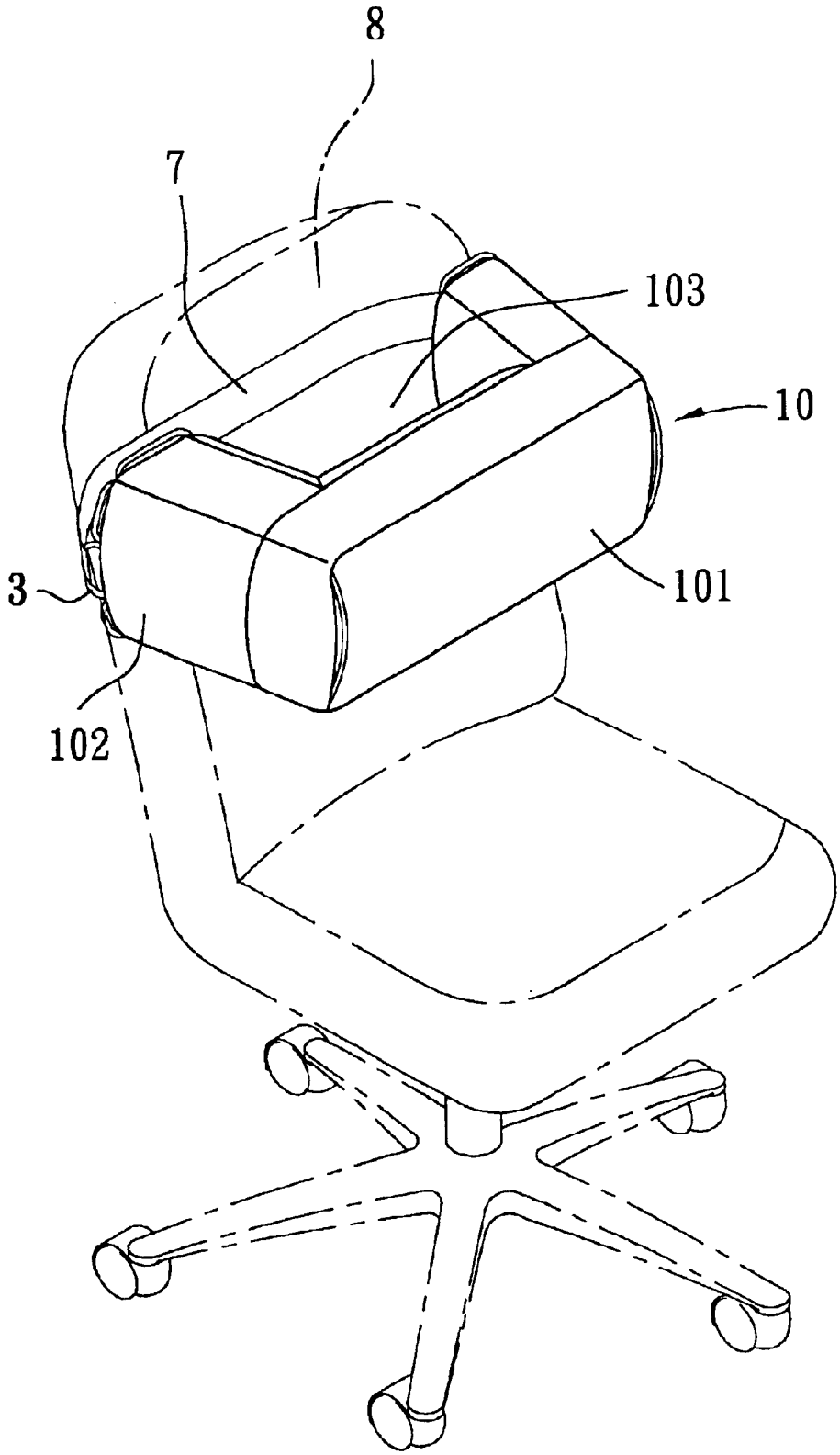
Figure 12:
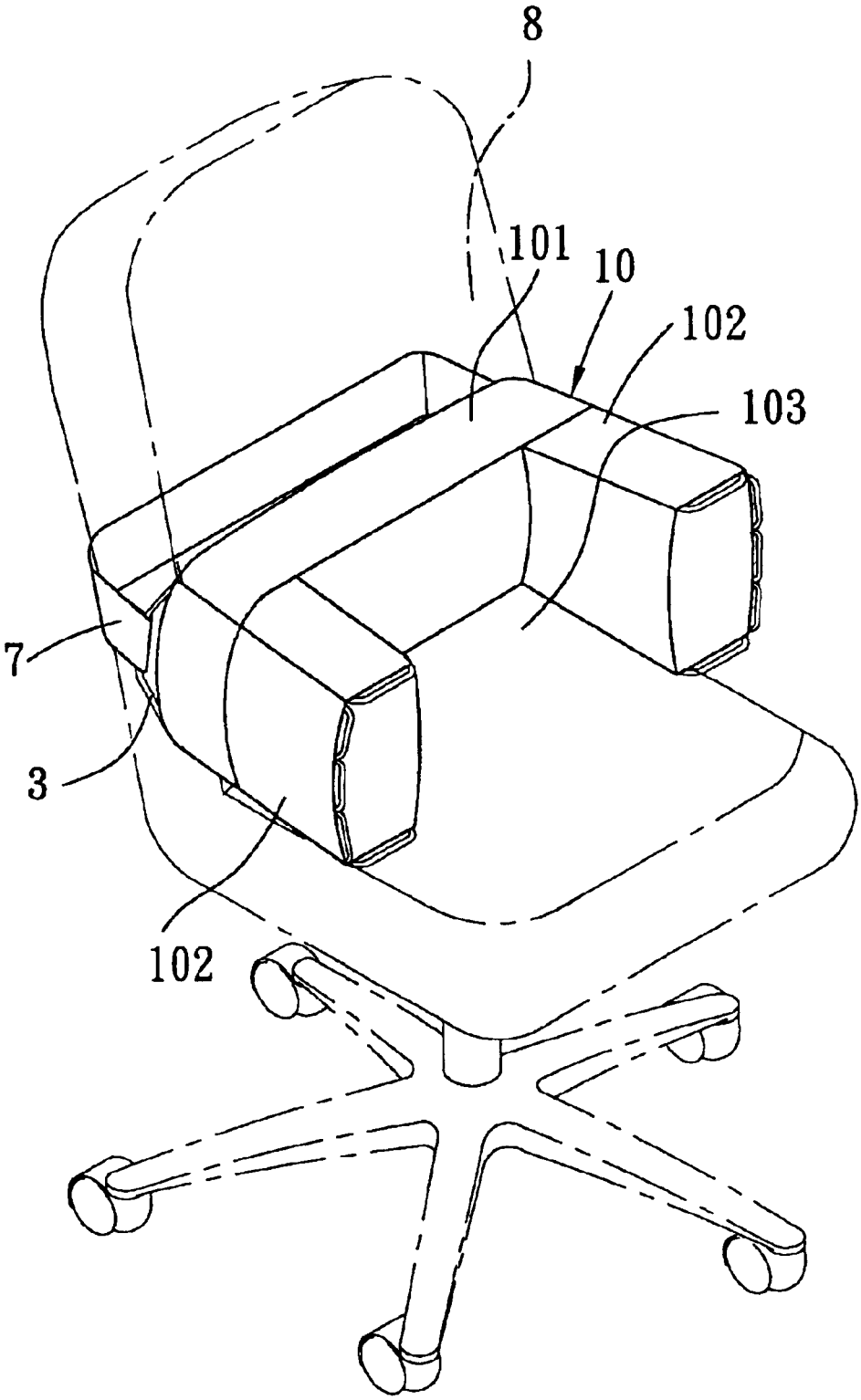
Figure 13:
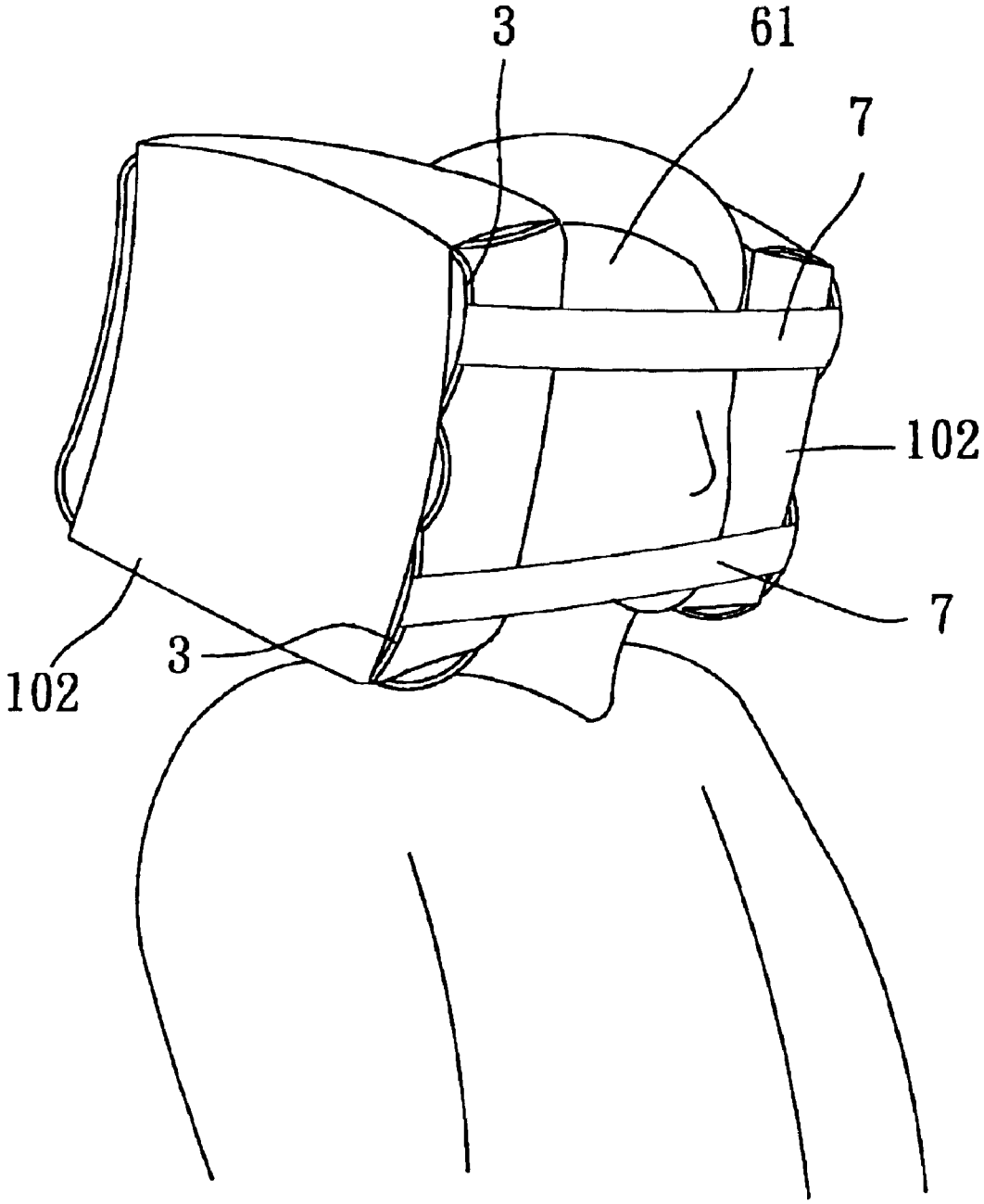

FIGS. 1 and 2 illustrate the first preferred embodiment of a support pillow according to this invention. The support pillow includes: a U-shaped body skin 12 that defines a U-shaped inner space 13 therein; and a filler 4 that is packed in the inner space 13 and that cooperates with the body skin 12 to form a flexible U-shaped body 10 which includes a bight part 101 and two opposite arm parts 102 extending and angled away from two opposite ends of the bight part 101 to define a recess 103 thereamong.

The body skin 12 is formed with a plurality of separate pockets 15 at two opposite sides 1011, 1012 of the bight part 101 and at inner sides 1021 of the arm parts 101 of the U-shaped body 10. A plurality of rigid plates 2 are respectively received in the pockets 15 for providing a massaging effect to the user.

The body skin 12 is formed of overlapped inner and outer fabric sheets 121, 122 which are stitched together to form the pockets 15.

FIGS. 3 to 13 illustrate how the support pillow of this invention can be used for supporting various lying postures of the user 61.

A pair of opposite first loops 3, each of which is formed of a thread, are stitched to the body skin 12 at the opposite ends of the bight part 101 of the U-shaped body 10, respectively. An elastic strip 7 (see FIGS. 11 and 12) is connected to the first loops 3 so as to permit attachment of the support pillow to a chair 8.

A plurality of pairs of second loops 3, each of which is formed of a thread, are stitched to free ends of the arm parts 102 of the U-shaped body 10. Two second elastic strips 7 (see FIG. 13) are respectively connected to selected pairs of the second loops 3.

Figure 14:
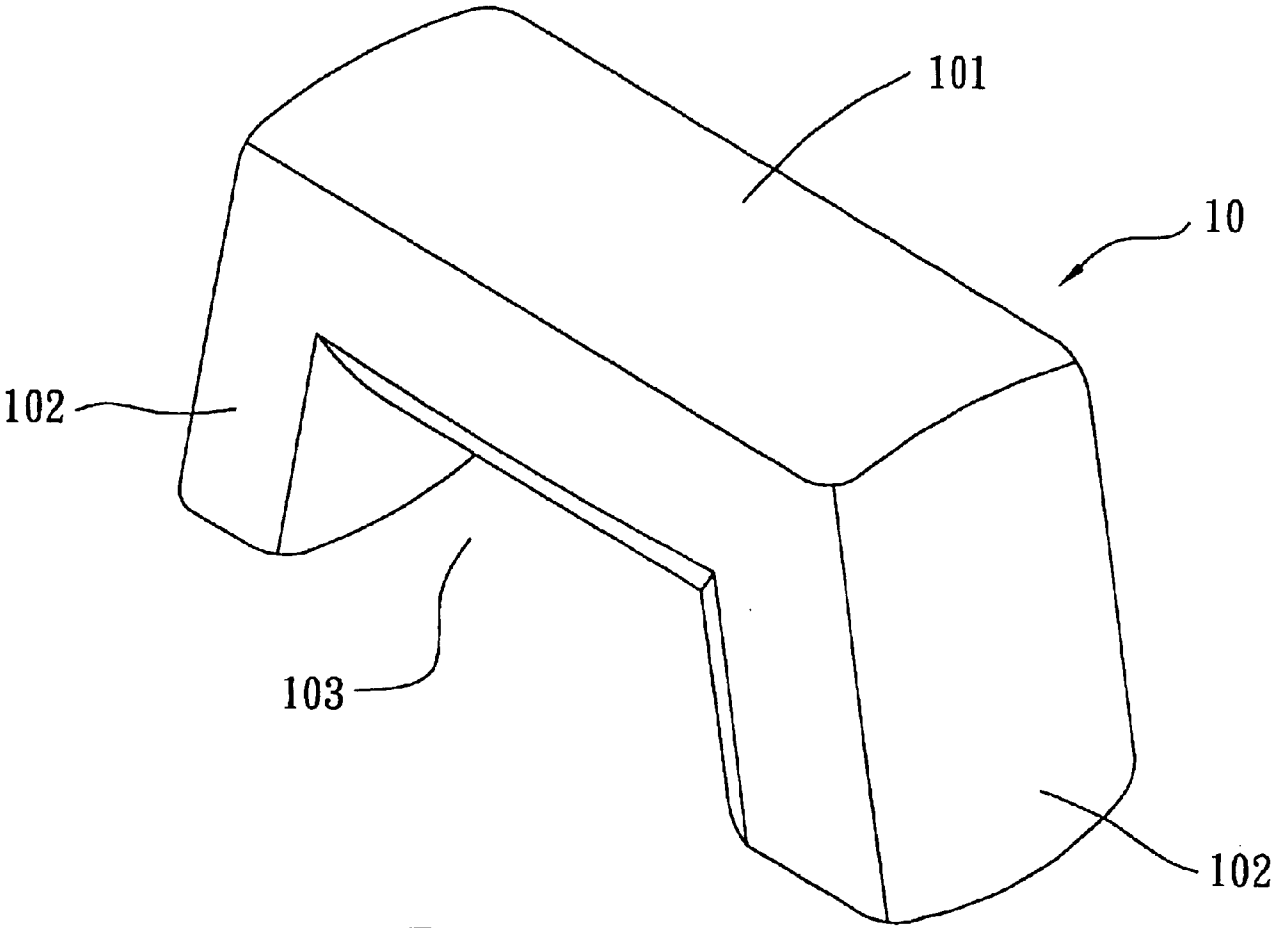
FIG. 14 is a perspective view of the second preferred embodiment of the support pillow according to this invention.

FIG. 14 illustrates the second preferred embodiment of the support pillow according to this invention. The support pillow is in the form of a single piece integrally formed foam body 10, and is U-shaped. The foam body 10 can be made from a latex material or a silicon material, and includes a bight part 101 and two opposite arm parts 102 that extend from two opposite ends of the bight part 101 to define a recess 103 thereamong.

By virtue of the U-shaped body 10 of the support pillow of this invention, the aforesaid drawback associated with the prior art can be eliminated.

With the invention thus explained, it is apparent that various modifications and variations can be made without departing from the spirit of the present invention.

I claim:

1. A support pillow comprising:

a U-shaped body skin that defines a U-shaped inner spacer therein; and a filler that is packed in said inner space and that cooperates with said body skin to form a flexible U-shaped body which includes a bight part and two opposite arm parts extending and angled away from two opposite ends of said bight part to define a recess thereamong; and a plurality of separate pockets at said bight part and said arm parts of said U-shaped body, said support pillow further comprising a plurality of rigid plates that are respectively received in said pockets.

2. The support pillow of claim 1, wherein said body skin is formed of overlapped inner and outer fabric sheets which are stitched together to form said pockets.

3. The support pillow of claim 2, further comprising a pair of opposite loops that are connected to said body skin at said opposite ends of said bight part of said U-shaped body, respectively, and an elastic strip that is connected to said loops.

* * * * *